United States Patent [19]

Kawasaki

[11] Patent Number: 4,913,105

[45] Date of Patent: Apr. 3, 1990

[54] HYDRAULIC LASH ADJUSTER

[75] Inventor: Hiroshi Kawasaki, Tokorosawa, Japan

[73] Assignee: Honda Giken Kogyo Kabushiki Kaisha, Tokyo, Japan

[21] Appl. No.: 709,838

[22] Filed: Mar. 8, 1985

Related U.S. Application Data

[63] Continuation of Ser. No. 526,776, Aug. 26, 1983, abandoned.

[30] Foreign Application Priority Data

Aug. 27, 1982 [JP] Japan ..... 57-148574

[51] Int. Cl.[4] ..... F01L 1/24

[52] U.S. Cl. ..... 123/90.46; 123/90.27; 123/90.55

[58] Field of Search ..... 123/90.27, 90.43, 90.46, 123/90.56, 90.55

[56] References Cited

U.S. PATENT DOCUMENTS

| | | | |
|---|---|---|---|
| 2,021,333 | 11/1935 | Storey | 123/90.46 |
| 2,041,983 | 5/1936 | Van Ranst | 123/90.55 |
| 2,672,133 | 3/1954 | Etchells | 123/90.55 |
| 2,772,667 | 12/1956 | Nallinger | 123/90.43 |
| 2,938,508 | 5/1960 | Papenguth | 123/90.59 |
| 2,954,017 | 9/1960 | Forstner | 123/90.43 X |
| 3,306,271 | 2/1967 | Turlay | 123/90.27 |

FOREIGN PATENT DOCUMENTS

| | | | |
|---|---|---|---|
| 949852 | 9/1956 | Fed. Rep. of Germany | 123/90.46 |
| 1293787 | 4/1969 | Fed. Rep. of Germany | 123/90.27 |
| 259670 | 7/1928 | Italy | 123/90.43 |

*Primary Examiner*—Ira S. Lazarus
*Assistant Examiner*—Peggy A. Neils
*Attorney, Agent, or Firm*—Armstrong, Nikaido, Marmelstein, Kubovcik & Murray

[57] ABSTRACT

A hydraulic lash adjuster comprising: a body having a blind longitudinal bore and an outer diameter; a plunger slidably fitted in said bore having an end extending therefrom, said plunger defining a high pressure chamber in the blind end of the bore, said plunger having a hollow core and an opening in its end facing the high pressure chamber defining a valve seat; a check ball abutting said valve seat; a ball cage attached to said plunger; a spring means in the high pressure chamber biasing the plunger; a means in said body and said plunger for communicating a supply of oil to the hollow core; and a cylindrical cap removeably fitted on the end of the plunger extending from the bore, said cap having practically the same outer diameter as the plunger and a flat top.

1 Claim, 6 Drawing Sheets

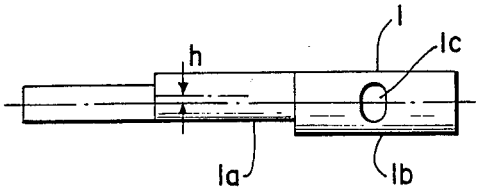
FIG. 1 PRIOR ART
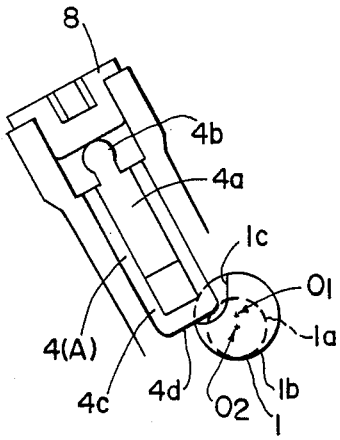
PRIOR ART FIG. 3
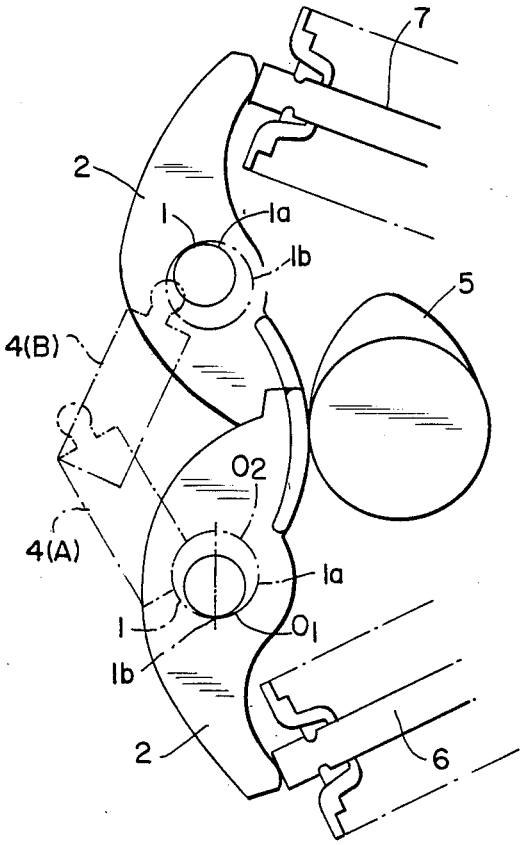
FIG. 2 PRIOR ART
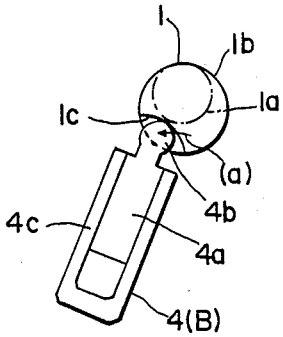
FIG. 4 PRIOR ART

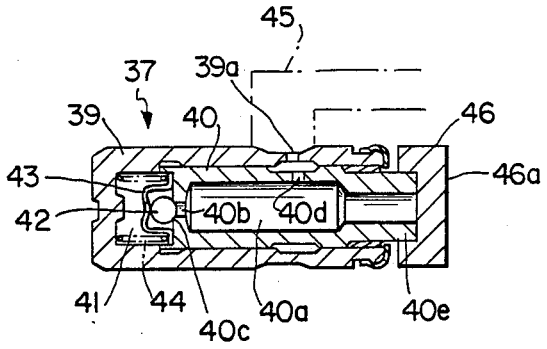
FIG. 9
FIG. 11(a)
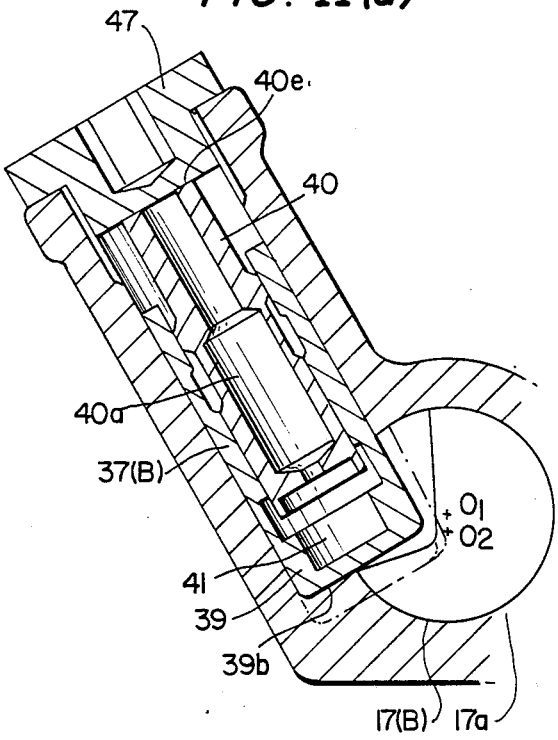
FIG. 11(b)
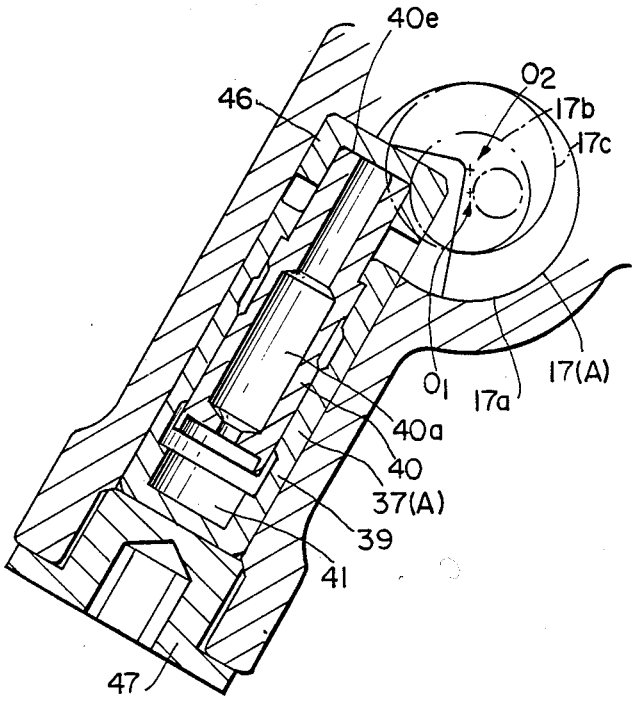

HYDRAULIC LASH ADJUSTER

This application is a continuation of application Ser. No. 526,776, filed Aug. 26, 1983 now abandoned.

BACKGROUND OF THE INVENTION

This invention relates to a hydraulic lash adjuster for use in the valve operating mechanism of a four-cycle engine.

Hydraulic lash adjusters are being increasingly used in various four-cycle engines because they enable zero lash operation of the valve operating system, low noise operation and minimal maintenance. When a hydraulic lash adjuster (hereinafter referred to as "the lash adjuster") is used in a parallel multicylinder or a single cylinder enginer where the cylinder section is oriented upwardly, or in a V-engine, there are generally no problems. However, when it is used in a horizontal opposed engine, for instance, where the cylinder section is disposed horizontally, or in an engine where it is disposed aslant close to a horizontal position, the lash adjuster is turned sideways or upside down. Because of this, oil in the high pressure chamber for giving static pressure reaction to the slidably incorporated plunger flow out thereby rendering the lash adjuster inoperative.

In order to avoid this problem, a construction has been conceived for a horizontal engine wherein the lash adjuster is installed upright or only somewhat aslant to an extent so as not to cause trouble. Such a construction is shown in FIGS. 1 to 4. The axis $O_2$ of the rocker arm support 1*a* of the rocker arm shaft 1 is offset in the amount of "h" in reference to the center $O_1$ of the rocker arm shaft 1. The rocker arm 2 is supported by the rocker arm support 1*a* (that is, the offset portion) and performs zero lash by means of lash adjuster 4 engaged with the engaging cavity 1*c* provided on not-offset portion 1*b*. That is, it performs operation where contact between cam 5 and the rocker arm 2 will not develop clearance. The head 4*b* of the plunger 4*a* of the lash adjuster 4 has been formed into a spherical shape.

In the conventional construction as described above, contact of the lash adjuster 4 with the engaging cavity 1*c* of the rocker arm shaft 1 is made by using the bottom 4*d* of the lash adjuster 4 (that is, the bottom of the body 4*c*) for the exhaust valve 6 side, for instance, and by using the head 4*b* of the lash adjuster 4 (that is, the head of the plunger 4*a*) for the intake valve 7 side on the other hand, so that:

(1) In the lash adjuster 4(A) of the bottom 4*d* contact type, because the head 4*b* of the plunger 4*a* is spherical, the head 4*b* abuts on the plug 8 by a point contact as shown in FIG. 3 for disadvantage of durability with respect to wear;

(2) In the lash adjuster 4(B) of the head 4*b* contact type, because the plunger head 4*b* is in contact with the engaging cavity 1*c* of the rocker arm shaft 1 and because the engaging cavity 1*c* of the lash adjuster 4(B) is formed into an almost spherical shape as shown in FIG. 4, force in the direction of arrow (a) acts according to movement of the plunger 4*a* to injure the smoothness of mutual sliding between the plunger 4*a* and lash adjuster body 4*c*. Because of spherical shape of the head 4*b* resulting in only point contact, it also is disadvantageous in durability with respect to wear; and (3) Because the rocker arm 2 turns, it is necessary to provide a member for receiving axial thrust of the rocker arm shaft 1, which results in a disadvantage of cost increase.

This invention was produced in view of such circumstances and the object thereof is to eliminate the above described disadvantages by removably providing a plunger cap on the plunger head of the hydraulic lash adjuster.

BRIEF DESCRIPTION OF THE DRAWINGS

The above and other objects and the attendant advantages of the present invention will become readily apparent by reference to the following detailed description when considered in conjunction with the accompanying drawings wherein:

FIGS. 1 to 4 show a conventional hydraulic lash adjuster, FIG. 1 is a front view of the rocker arm shaft, FIG. 2 is a sectional view showing an important part of the valve operating mechanism, FIGS. 3 and 4 are enlarged views showing important parts in FIG. 2 respectively;

FIGS. 5 to 12 show an embodiment of this invention, FIG. 5 is an exploded oblique view showing the cylinder head section of a horizontal opposed type cylinder engine, FIG. 6 is an exploded oblique view showing the cam holder section, FIGS. 7(*a*) and (*b*) are a front view and a side view showing the rocker arm shaft respectively, FIG. 8 is an explanatory drawing of the rocker arm shaft arrangement, FIG. 9 is a sectional view showing the hydraulic lash adjuster, FIG. 10 is a sectional view showing an important part of the valve operating mechanism, FIGS. 11(*a*) and (*b*) are enlarged views showing important parts in FIG. 10 respectively, and FIG. 12 is an arrow view of A in FIG. 10.

DETAILED DESCRIPTION OF PREFERRED EMBODIMENT

By referring to FIG. 5 and subsequent figures, an embodiment of this invention applied to a horizontal opposed type cylinder engine of a motorcycle is described below.

Figure 5:
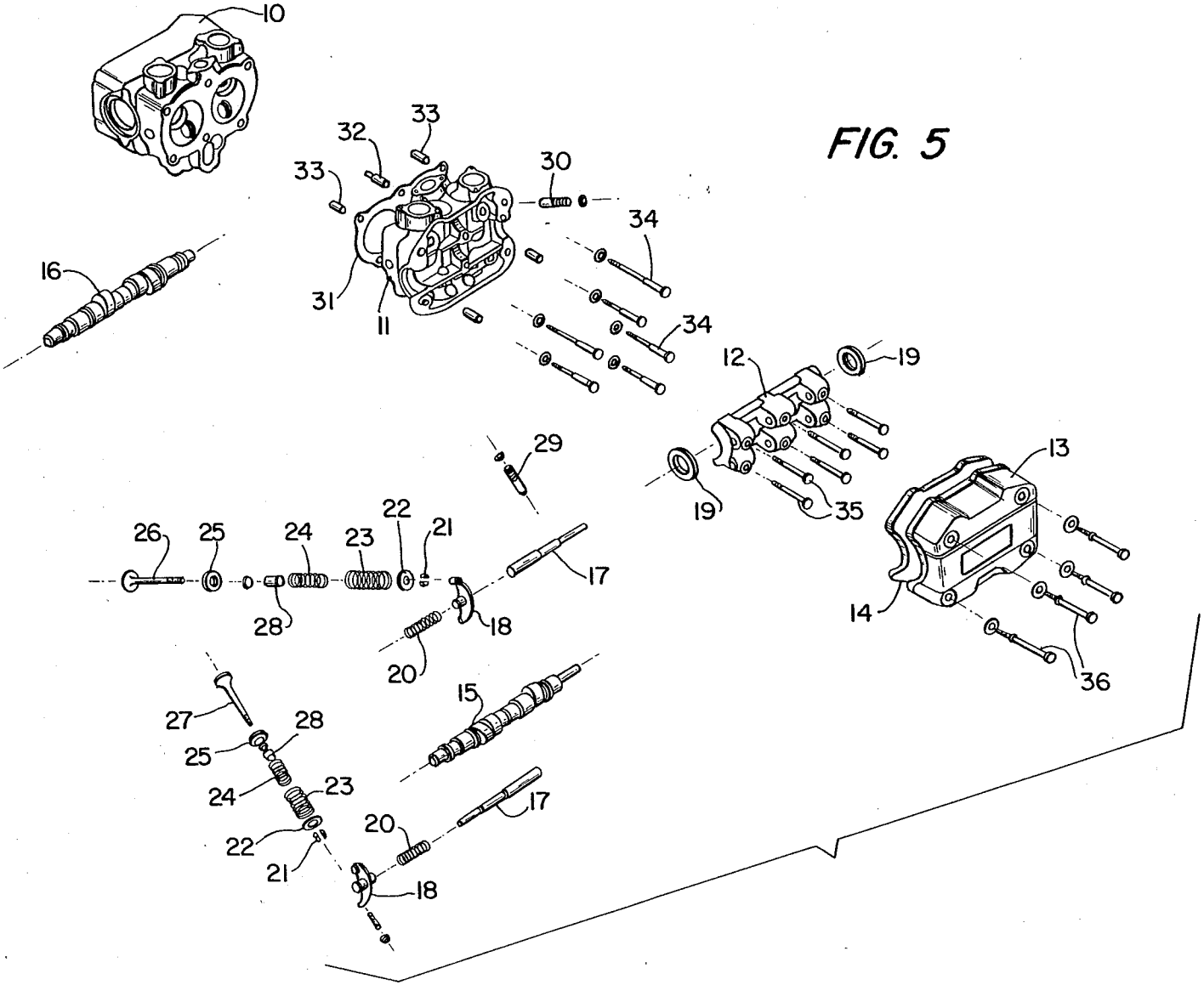

FIG. 5 is an exploded oblique view showing a cylinder head section of a horizontal engine. One of the entire cylinder heads 10 of the engine horizontally is shown assembled, the rest of FIG. 5 shows the parts in exploded view of the other cylinder head 11 of the engine opposed thereto. 11 is a cylinder head, 12 a cam holder, 13 a cylinder head cover, 14 a head gasket, 15 a cam shaft of the cylinder head 11, 16 a camshaft of the cylinder head 10, 17 a rocker arm shaft, 18 a rocker arm, 19 an oil seal, 20 a rocker arm side spring, 21 a valve cotter, 22 a valve spring retainer, 23 a valve outer spring, 24 a valve inner spring, 25 a valve spring seat, 26 an intake valve, 27 an exhaust valve, 28 a valve stem seal, 29 an exhaust valve guide, 30 an intake valve guide, 31 a cylinder head gasket, 32 an oil control orifice, and 33 a dowel pin. And, 34 a bolt for fixing the cylinder head 11 to a cylinder block not shown, 35 a bolt for fixing the cam holder 12 to the cylinder head 11, and 36 a bolt for fixing the cylinder head cover 13 to the cylinder head 11.

Figure 6:
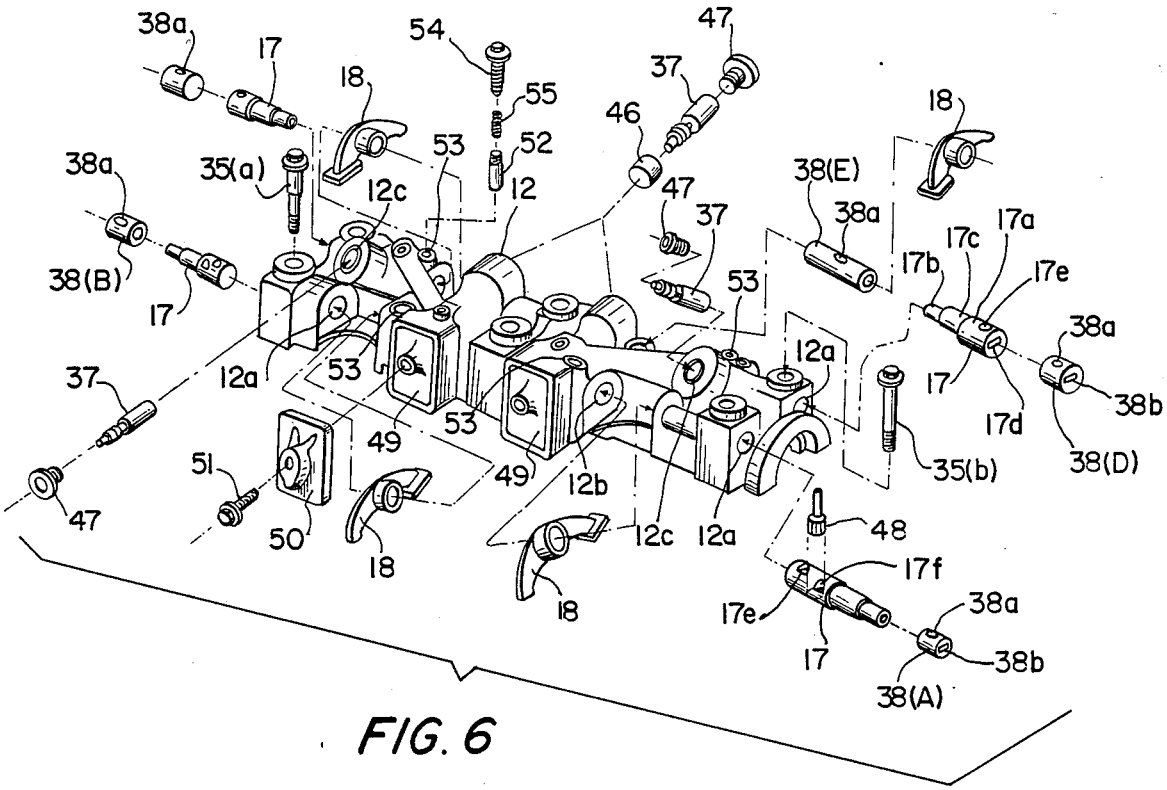

Explaining in detail by referring to FIG. 6, the cam holder 12 and those parts to be installed thereon, the camshaft 15 is rotatably supported by the split-half cam holder 12 and a semi-circular receiver formed on the cylinder head 11. On the cam holder 12 are installed four each of the rocker arm 18, four hydraulic lash adjusters 37 and others.

Figure 7A:
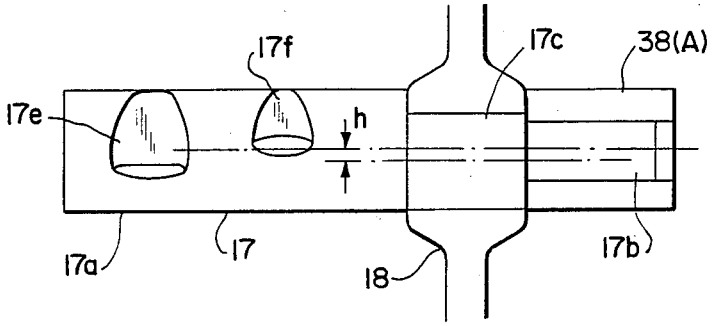
Figure 7B:
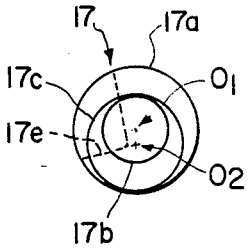
Figure 8:
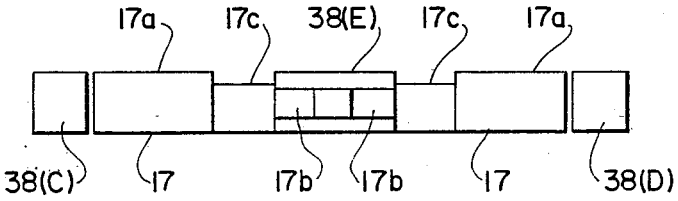

As shown in FIGS. 7(*a*) and (*b*) and also in FIG. 8, the rocker arm shaft 17 has a large diameter portion 17*a* and a small diameter portion 17*b* on each side in the longitudinal direction. A rocker support 17*c* has the axis $O_2$ offset by the amount of "h" in reference to the axis $O_1$ of the rocker arm shaft 17 (that is, the axis of the large diameter portion 17*a* and small diameter portion 17*b*) in the intermediate portion. The shaft 17 is supported with both ends inserted into holes 12*a*, 12*b* drilled in the cam holder 12. Collars 38(A), 38(B), 38(E) of the same outside diameter as the large diameter portion 17*a* are inserted over the small diameter portion 17*b*, and through these collars 38, the small diameter portion 17*b* is supported in either hole 12*a* or 12*b*. Collars 38(C), 38(D) are for preventing the rocker arm shaft 17 from coming off and are of the same outside diameter as the large diameter portion 17*a*. Similarly to the collars 38(C), 38(D), the collars 38(A), 38(B) also serve to prevent the rocker arm shaft 17 from coming off. The collars 38(A), 38(B) and the collars 38(C), 38(D) are fixed to the cam holder 12 with bolts 35(*a*) (only one bolt is shown) inserted through a through hole 38*a* and with a bolt 35(*b*) inserted through a through hole 28*a*, respectively. A slot 38*b* is provided for angle adjustment by turning with a screwdriver in setting. A slot 17*d* on the rocker arm shaft 17 end is also a slot to receive a screwdriver for angle adjustment in setting. The rocker arm 18 can turnably fit to said rocker arm support 17*c*.

Each of said lash adjusters 37 is inserted into a respective cylindrical hole 12*c* formed in the cam holder 12.

Referring to FIG. 9, the lash adjuster 37, includes a lash adjuster body 39 (hereinafter referred to as "body"), a plunger 40 slidably fitted in a cylindrical hollow portion provided in the body 39, a high pressure chamber 41 formed on the bottom side of the plunger 40, a check ball 42 abutting on a valve seat 40*c* formed at the end of a passage 40*b* connecting a hollow portion 40*a* of a plunger 40 to the high pressure chamber 41, a cage 43 enclosing the check ball 42 with a small clearance so as to prevent it from separating excessively from the valve seat 40*c* fixed to the plunger 40, and a plunger spring 44 for energizing the plunger 40 provided in the high pressure chamber 41. Furthermore, connecting holes 39*a*, 40*d* connecting between an oil feed passage 45 formed in the cam holder 12 and the hollow portion 40*a* of the plunger 40 are provided in the body 39 and plunger 40 respectively. The head 40*e* of the plunger 40 is formed into a cylindrical shape and a cap 46 is removably installed on said head 40*e*. The cap 46 has practically the same outside diameter as the outside diameter of the body 39 and has a flat top 46*a*.

The lash adjuster 37 is held in the cylindrical hole 12*c* of the cam holder 12 by a plug 47.

An engaging cavity 17*e* with which the lash adjuster 37 engages and an engaging cavity 17*f* with which an auxiliary return pin 52 to be described later engages are formed on the large diameter portion 17*a* of the rocker arm shaft 17. The engaging cavities 17*e*, 17*f* are machined with an end milling cutter 48 as shown in FIG. 6 and have a cylindrical surface (only part of it) and a flat bottom.

Figure 10:
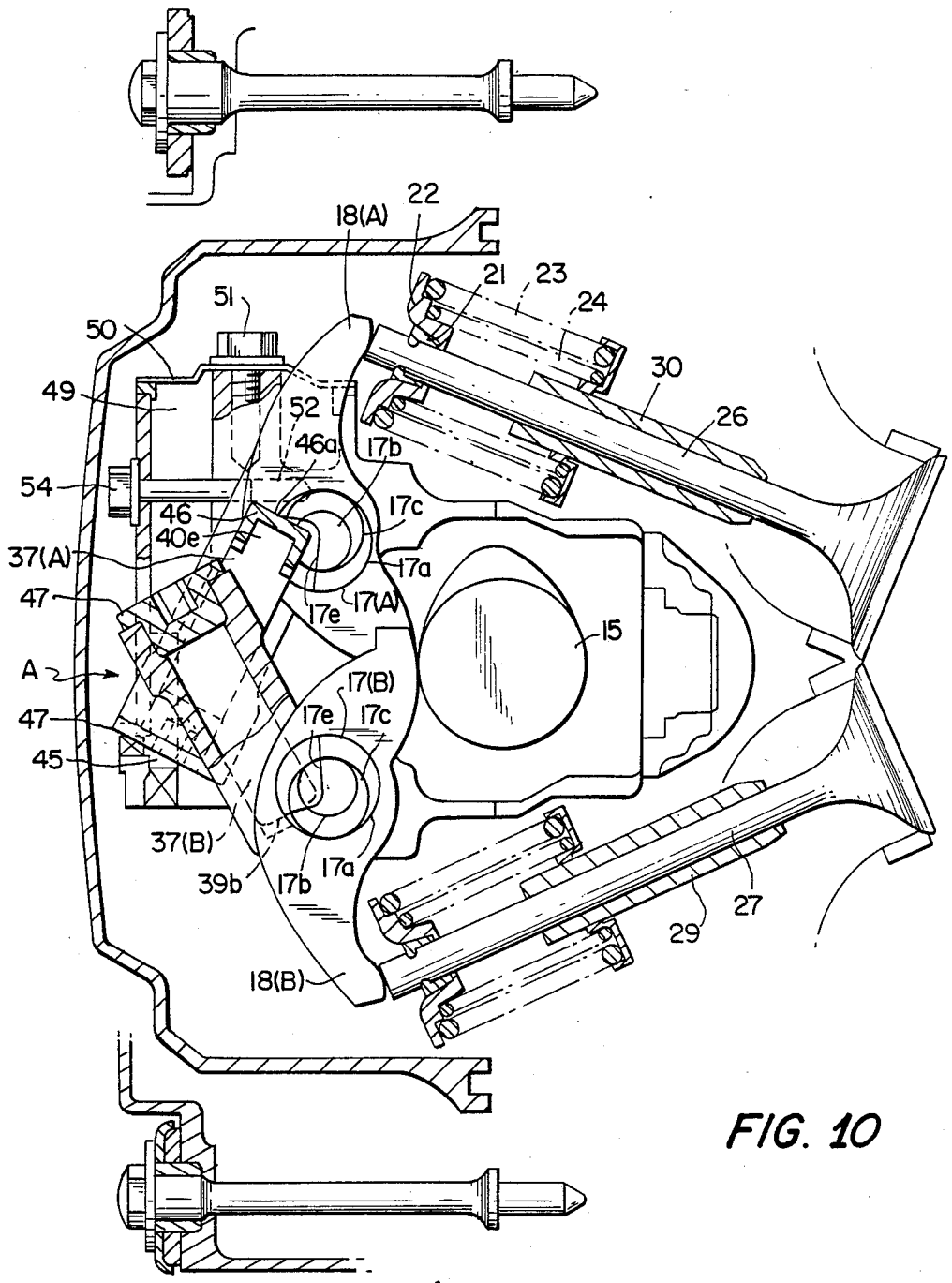
Figure 12:
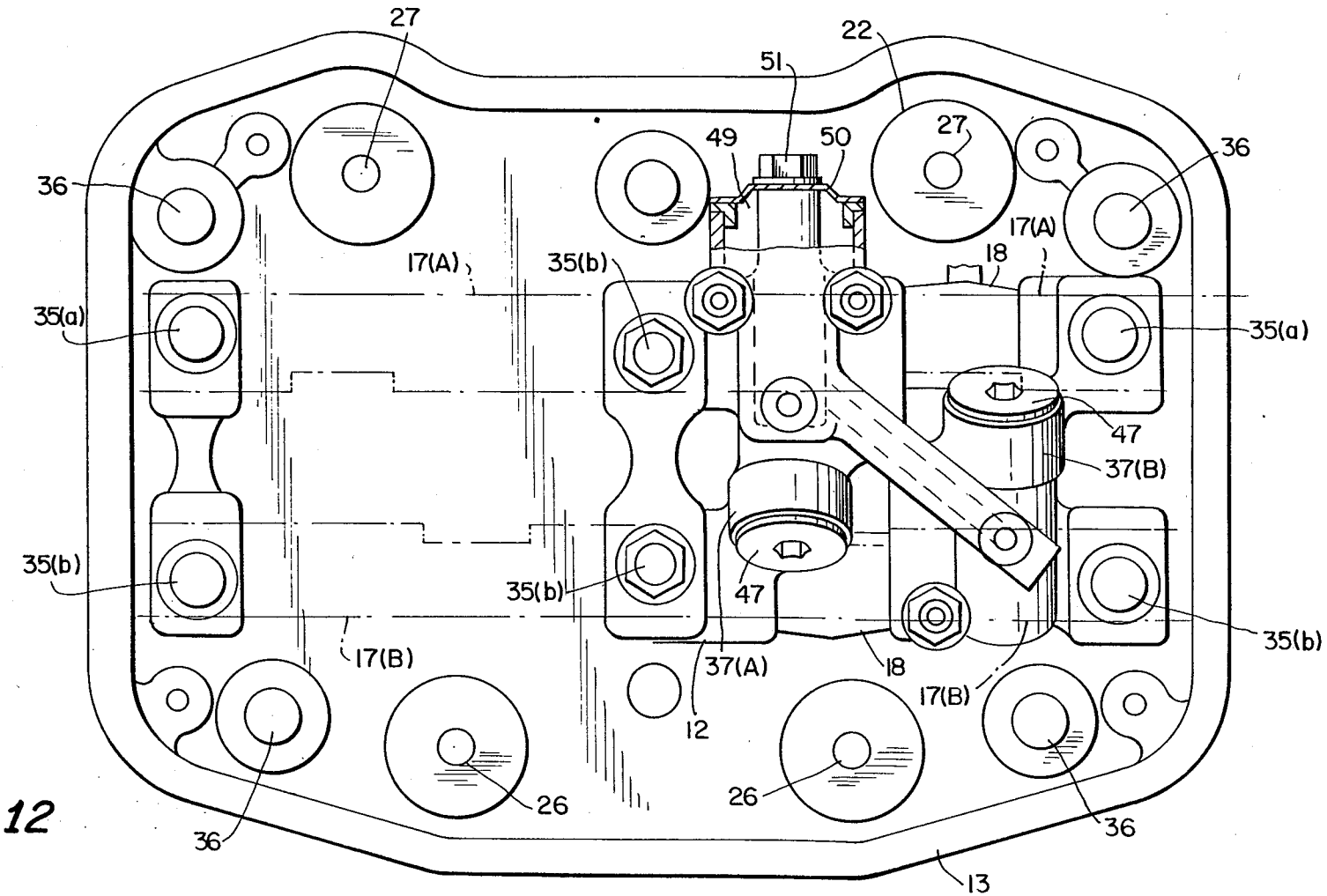

By referring to FIGS. 10 and 11, the arrangement relations between the lash adjuster 37 and the rocker arm shaft 17, rocker arm 19 are described: the lash adjuster 37(A) to engage with the rocker arm shaft 17(A) of the rocker arm 18(A) on the intake valve 26 side is engaged by its plunger head 40*e* side with the engaging cavity 17*e* of the rocker arm shaft 17(A) larger diameter portion 17*a* through the cap 46; the lash adjuster 37(B) to engage with the rocker arm shaft 17(B) of the rocker arm 18(B) on the exhaust valve 27 side is engaged by its body 39 bottom 39*b* side with the engaging cavity 17*e*. The vertical direction in FIG. 10 corresponds to the vertical direction of a motorcycle. Because in both lash adjusters 37(A), 37(B), the high pressure chamber 41 is located lower than the plunger 40, such disadvantage will not occur that oil in the high pressure chamber 41 flows out. No cap 46 is installed on the plunger head 40*e* of the lash adjuster 37(B) on the exhaust valve side and the flat top of the plunger head 40*e* abuts directly on the plug 47. Since the contact is between the flat surfaces, it is less in wear and excels in durability as compared with that of conventional spherical plunger head.

The before mentioned auxiliary return pin 52 is inserted into a cylindrical hole 53 drilled (four places) in the cam holder 12, with its tip abutting on said engaging cavity 17*f* of the rocker arm shaft 17, and is energized to the rocker arm shaft 17 side by a spring 55 held by a bolt 54. The auxiliary return pin 52 serves to assist the plunger 40 of the lash adjuster 37 to return in its returning from the sunk position by giving force to turn the rocker arm shaft 17.

49 is a chamber which is filled with oil to be supplied from an oil pump (not shown). 50 is a lid of this chamber 49 and is fixed with a bolt 51. Oil is led from the chamber 49 through the passage 45 to the connecting holes 39*a*, 40*d* of the lash adjuster 37.

Operation of the above described valve operating mechanism is described next.

As the cam 15 rotates, the rocker arm 18 swings to turn about the axis $O_2$ of the offset rocker arm support 17*c* of the rocker arm shaft 17 to operate the valves 26, 27. In this case, the rocker arm shaft 17 is restricted for turning by the lash adjuster 37 engaging with its engaging cavity 17*e*; however, because this restriction by the lash adjuster 37 is what is called a resilient restriction by static pressure reaction of oil in the high pressure chamber 41 and because by the fact that the axis $O_2$ of the rocker arm support 17*c* is offset, the center of turn of the rocker arm 18 can shift slightly by slight turn of the rocker arm shaft 17. It is thus possible to achieve low noise, zero lash operation and maintenance-free condition where the valve operating mechanism is maintained at zero clearance at all times.

In the above operation, as for the intake valve 26 side, the cap 46 of the plunger head 40*e* of the lash adjuster 37(A) is in contact with the engaging cavity 17*e* of the rocker arm shaft 17(A). Because this contact is made with the flat top 46*a* of the cap 46, unlike the contact between the spherical plunger head 4*b* and the spherical engaging cavity 1*c* shown in FIG. 4, it can have a sufficient contact surface to improve durability with respect to wear for improved realiability. Because the contact between the cap 46 and the engaging cavity 17*e* is a linear contact between the top 46*a* of the cap 46 and the edge of the engaging cavity 17*e*, it can lower the unit area pressure as compared with that of a point contact as in the conventional embodiment in FIG. 4. In addition, no load in the direction perpendicular to its sliding direction will act on the plunger 40, so that the lash adjuster 37 is smooth in operation and improved in durability and reliability.

Locating of the rocker arm shaft 17 with respect to the longitudinal direction is made by the periphery of the lash adjuster 37 body 39 for the exhaust valve 27 side and by the periphery of the body 39 for the intake valve 26 side. Furthermore, each body 39 and cap 46 to engage with the cylindrical surface of a respective engaging cavity 17*e* is the same in the outside diameter as the others, so that engaging cavities 17*e* of the same shape serve for the purpose. This eliminates the necessity of manufacturing rocker arm shafts of several kinds having engaging cavities corresponding to respective plunger heads and bodies, which is helpful in reduction of cost.

As is described in the foregoing, in accordance with the hydraulic lash adjuster of this invention, the head of the plunger is capped by a cap having practically the same outside diameter as the outside diameter of the lash adjuster body, so that when it is used in the valve operating mechanism of the engine of horizontal or nearly horizontally inclined cylinder arrangement, contact between the lash adjuster and the rocker arm support is such that it is not likely to develop wear. Further, no load in the direction perpendicular to its sliding direction will act on the plunger, whereby it is possible to improve the durability and reliability of the hydraulic lash adjuster and to eliminate the necessity of manufacturing rocker arm shafts of several kinds for reduction of cost and various other advantages.

It is readily apparent that the above-described hydraulic lash adjuster meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A hydraulic lash adjuster for an internal combustion engine having a cam holder and a rocker arm shaft, said rocker arm shaft having a cylindrically-cut engagement cavity, said cam holder having a cylindrical hole bored therein with one end opening toward said rocker arm shaft and the other end closed by a cover member, said hole having an inner diameter; said lash adjuster comprising: a body received entirely in said cylindrical hole and having a blind longitudinal bore and an outer diameter substantially the same as said inner diameter;

a plunger slidably fitted in said bore having an end extending therefrom, said plunger defining a high pressure chamber in the blind end of the bore, said plunger having a hollow core and an opening in its end facing the high pressure chamber defining a valve seat;

a check ball abutting said valve seat;

a ball cage attached to said plunger;

a spring means in the high pressure chamber biasing the plunger;

a means in said body and said plunger for communicating a supply of oil to the hollow core; and a cylindrical cap removeably fitted on the end of the plunger extending from the bore, said cap having practically the same outer diameter as the body and a flat top which engages said engagement cavity in said rocker arm shaft.

* * * * *